US008336619B2

(12) United States Patent
Nutley et al.

(10) Patent No.: US 8,336,619 B2
(45) Date of Patent: Dec. 25, 2012

(54) DOWNHOLE APPARATUS WITH A SWELLABLE MANTLE

(75) Inventors: Kim Nutley, Inverurie (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 402 days.

(21) Appl. No.: 12/595,085

(22) PCT Filed: Apr. 10, 2008

(86) PCT No.: PCT/GB2008/001256

§ 371 (c)(1),
(2), (4) Date: Mar. 16, 2010

(87) PCT Pub. No.: WO2008/122809

PCT Pub. Date: Oct. 16, 2008

(65) Prior Publication Data

US 2011/0042096 A1 Feb. 24, 2011

(30) Foreign Application Priority Data

Apr. 10, 2007 (GB) ..... 0706909.9

(51) Int. Cl.
*E21B 43/08* (2006.01)

(52) U.S. Cl. ..... 166/229; 166/234; 166/278; 166/387

(58) Field of Classification Search ..... 166/227, 166/229, 387, 234, 278
See application file for complete search history.

(56) References Cited

U.S. PATENT DOCUMENTS

| | | | | |
|---|---|---|---|---|
| 2005/0077052 | A1* | 4/2005 | Ohmer | 166/384 |
| 2005/0126776 | A1* | 6/2005 | Russell | 166/229 |
| 2005/0173130 | A1 | 8/2005 | Richard | |
| 2008/0283240 | A1* | 11/2008 | Baaijens et al. | 166/236 |

FOREIGN PATENT DOCUMENTS

| | | | |
|---|---|---|---|
| WO | 03008756 | A1 | 1/2003 |
| WO | 2006003112 | A1 | 1/2006 |

OTHER PUBLICATIONS

International Search Report for corresponding application No. PCT/GB2008/001256, dated Sep. 4, 2008.

McElfresh, et al., "Maximizing Inflow Performance in Soft Sand Completions Using New One-trip Sand Control Liner Completion Technology", SPE European Formation Damage Conference, pp. 1-5, May 25-27, 2005.

* cited by examiner

*Primary Examiner* — Giovanna Wright
(74) *Attorney, Agent, or Firm* — Wong, Cabello, Lutsch, Rutherford & Brucculeri, LLP

(57) ABSTRACT

A downhole apparatus is described comprising a main body coupled with a well tubing and a swellable mantle disposed on the main body. The swellable mantle expands upon contact with at least one predetermined fluid, and the main body comprises at least one opening for fluid flow between an exterior of the main body and the bore. An insert permits the passage of fluid, through the swellable mantle, between the exterior of the apparatus and the opening. In one aspect of the invention a screen filters solids between the exterior of the apparatus and the bore, and a swellable mantle comprises a first region which allows the passage of fluid between the exterior of the apparatus and the main body and a second region, circumferentially adjacent the first region, which substantially prevents passage of fluid. Corresponding well completion and production methods are also described.

53 Claims, 7 Drawing Sheets

1/7

10
12
14
16
18
20
22
24
26

DOWNHOLE APPARATUS WITH A SWELLABLE MANTLE

CROSS-REFERENCE TO RELATED APPLICATIONS

The present application is a National Stage entry from PCT Patent Application No. PCT/GB2008/001256, filed Apr. 10, 2008, which claims priority to United Kingdom Patent Application No. GB0706909.9, filed on Apr. 10, 2007, the contents of each one incorporated herein by reference.

FIELD OF THE INVENTION

The present invention relates to a downhole apparatus and method for use in the completion of hydrocarbon wells, and in one aspect to a downhole screen including a swellable material and a method of use.

BACKGROUND

In the completion of hydrocarbon wells, it is known to use screens to prevent the production of solids from the formation. Expandable tubular technology has been used to expand metal screens to reduce the annular space around the screen and thereby reduce or eliminate the requirement for gravel packing and provide structural support for the formation.

There are a number of drawbacks to using expanding tubulars. It can be difficult to control the force used to expand the tubular, and there may be resulting problems with the application of an undue, damaging force onto the formation. Expandable tubulars also have a limited expansion range, which means that maximum expansion can still result in an unsupported formation in a wash out zone.

US 2005/0173130 describes an arrangement in which a swellable layer is located over an expanding screen to allow the apparatus to conform to the borehole shape. Holes in the swellable layer allow the passage of formation fluids. However, it is desirable in many applications to avoid the use of expanding tubulars. Additionally, by providing the screen around the expandable pipe at a location displaced from the borehole wall, there is an annular space into which solids may be produced, and along which solids may flow. This increases the risk of blocking the screen and creating so-called hotspots which are prone to erosion.

The proposal of WO 2006/003112 attempts to overcome these deficiencies by providing a screen which is expanded into contact with the borehole wall by swellable rings. This approach relies on overlaid screen sheets which are forced outward by the swelling of the rings. This has the undesirable effect of restraining expansion of the swellable material, which may only be capable of exerting a pressure of 50 to 100 PSI (345 to 690 KPa). In addition, the gaps between overlaid screen sheets provide route for solid particles to enter the production tubing.

SUMMARY

It is one aim of at least one aspect the invention to provide a downhole apparatus and method which overcomes or mitigates the deficiencies of previously proposed apparatus and methods.

It is another aim of at least one aspect of the invention to provide an alternative apparatus and method to those previously proposed.

It is an aim of at least one aspect of the invention to provide a downhole apparatus offering improved performance and or wider operating parameters than the apparatus of the prior art.

According to a first aspect of the invention there is provided a downhole apparatus comprising a main body having a bore arranged to be coupled with a well tubing; and a swellable mantle disposed on the main body, which swellable mantle expands upon contact with at least one predetermined fluid; wherein the main body comprises at least one opening for fluid flow between an exterior of the main body and the bore, and the swellable mantle is provided with an insert to permit the passage of fluid between the exterior of the apparatus and the at least one opening through the swellable mantle.

Thus the apparatus may permit fluid flow from its exterior into the bore, through the openings in the main body, and onward to the well tubing. The apparatus may therefore communicate with production tubing, and may be adapted to permit flow of production fluid from a producing zone into the production tubing.

The swellable mantle may be disposed around an elongate portion of the main body, and may form a substantially cylindrical member around the main body. The elongate portion may comprise at least one opening therein, and the swellable mantle may be adapted to allow the passage of fluid between the exterior of the apparatus and the at least one opening in the elongate portion. The apparatus may therefore be arranged to permit fluid flow across an area or surface over which the swellable mantle is disposed.

The main body may be a tubular, and may form a base pipe of the apparatus. The main body may comprise a liner tubular. Preferably, the main body comprises a plurality of openings. The openings may be slots or perforations. The main body may therefore be a slotted or pre-perforated tubular.

In a preferred embodiment, the main body is formed to a fixed diameter, and is not adapted for expansion in use.

The swellable mantle may be provided with at least one formation to promote fluid flow between the exterior of the apparatus and the at least one opening.

Preferably, the swellable mantle is provided with at least one aperture therein. The aperture may be a hole, groove or slot in the swellable mantle. The aperture may be a radial opening in the swellable mantle. The aperture may comprise a groove extending circumferentially of the swellable mantle, and may comprise an annular groove in the swellable mantle. Alternatively, or in addition, the aperture may comprise a groove extending longitudinally of the swellable mantle. The aperture may comprise a groove defining a groove axis, which may be oriented longitudinally, circumferentially, or helically of the swellable mantle.

The aperture may comprise a hole extending radially of the swellable mantle.

The aperture may provide a fluid flow path from the exterior of the apparatus to main body. The apparatus may comprise a flow path from the exterior of the apparatus to the bore, via the aperture and the at least one opening in the main body. The flow path may be from a producing formation to the bore, via the aperture and the at least one opening in the main body.

The insert may be provided in the aperture. The insert preferably permits fluid flow through the aperture. The insert may be adapted to maintain a flow path in the aperture. The insert may comprise a fluid permeable material. The insert may function as a filter for filtering solid particles from the fluid flowing through the aperture.

The insert may be disposed over one or more openings of the main body. The insert may extend longitudinally and/or radially of the main body. The insert may substantially fill a volume defined by the aperture. The insert may function to support or abut a portion of the swellable mantle, and may define a bearing surface for a portion of the swellable mantle. The insert may therefore limit or prevent the expansion of the swellable mantle in at least one direction, and may be arranged to prevent the expansion of the swellable mantle into the flow path defined by the aperture.

The insert may be formed from a permeable rope, a braided line or a fibrous material, which may be wound into the aperture. Alternatively, the insert may comprise a sintered metal component.

In a further alternative, the insert may comprise an impermeable metal component having fluid apertures formed therein. The insert may comprise an abrasion- or erosion-resistant material such as tungsten carbide or similar.

The insert may define a conduit in the swellable mantle. The insert may define a radially extending conduit through an aperture in the swellable mantle. The conduit may be a bounded conduit, which may be adapted to maintain a flow path in the aperture. The conduit may be defined by a tube. The conduit may extend from the exterior of the swellable mantle to main body. The conduit may have a first end arranged for fluid flow to and/or from an exterior of the apparatus and a second end arranged for fluid flow to and/or from the main body. The second end may be located at or adjacent to the main body. The second end may be coupled to the apparatus at an opening on the main body. Alternatively, the second end may fully or partially extend into main body. The second end may be bonded to the main body.

The conduit may be of variable length. The conduit may be telescopic, and may comprise a first member at the first end, movably coupled to a second member at the second end. The first and second members may therefore move relative to one another to create a channel of variable length. Such relative movement result from expansion of the swellable mantle. The second member may be bonded to the swellable mantle. The first member may be adapted to move relative to the second member on expansion of the swellable mantle. A seal may be provided between the first and second members.

In an embodiment of the invention, there is provided one or more flow-directing members or channels disposed on an outer surface of the apparatus. The flow-directing member may be adapted to couple multiple apertures, and or direct flow to multiple apertures. The flow-directing member may be provided with holes corresponding to apertures in the swellable mantle. The flow-directing member may provide a fluid path from the exterior of the apparatus to one or more apertures. The flow-directing member may be coupled to an insert to an aperture.

Preferably, the flow-directing member is coupled to multiple inserts, and may be integral therewith. More preferably, the flow-directing member is coupled to multiple conduits, or first members thereof. The flow directing member may partially or fully define the inserts to the apertures.

The flow-directing member and the inserts can be considered in one embodiment to function as a gutter and a series of drainpipes respectively.

Preferably, the apparatus comprises a screen for filtering solids between the exterior of the apparatus and the bore. Preferably the screen is arranged to filter solids from fluid flowing from the exterior of the apparatus to the bore. The screen functions to filter solids produced from the formation, such as sands or shale or the like, from the fluid. The screen may comprise a plurality of layers. The screen may comprise at least one mesh layer, but preferably comprises a plurality of mesh layers.

The screen may comprise a filter mesh layer having a filter grade of 50 microns to 350 microns. The screen may further comprise one or both of an outer protective shroud or a drainage support mesh layer. Preferably, the screen comprises a first drainage support mesh layer on one side of a filter mesh layer, and a second drainage support mesh layer on an opposing side of a filter mesh layer.

The screen is preferably disposed over the openings. More preferably, the screen is disposed over the apertures. The screen may be disposed in the flow-directing member.

The apparatus may comprise multiple screens at discrete locations. The apparatus may comprise at least two screens having different filter grades.

The swellable mantle is preferably disposed around the main body and may be arranged to expand upon contact with at least one predetermined fluid and thereby move the screen outwardly of the main body. The screen is preferably arranged such that any restraining force imparted by the screen onto the swellable mantle which acts against its expansion can be overcome by the swellable mantle. More preferably, substantially no restraining force is imparted on the swellable mantle by the screen.

The apparatus may be arranged such that the surface area of the screen is maintained in use, between an unexpanded condition and an expanded condition. The screen may have a screen surface area; and the swellable mantle may be disposed around the main body between the main body and the screen. Preferably, the swellable mantle is arranged to expand upon contact with at least one predetermined fluid and thereby move the outwardly of the main body while maintaining the screen surface area.

The swellable mantle may comprise a first region located between the main body and the screen which allows the passage of fluid between the exterior of the apparatus and the main body. The swellable mantle may include a second region, which may be circumferentially adjacent the first region, which substantially prevents passage of fluid between the exterior of the apparatus and the main body.

Preferably, the second region is adapted to be expanded into contact with the borehole wall.

The screen may be discontinuous around the circumference of the main body. The screen may consist of multiple portions of screening material, which may be discrete in an expanded condition of the apparatus. The multiple portions may additionally be discrete in an unexpanded condition of the apparatus. Preferably, the swellable member is disposed around the main body between the main body and the screen such that on expansion the screen is moved outwardly of the main body. The screen may comprise at least two discrete screens or screen sections circumferentially spaced on the apparatus.

Preferably, the swellable mantle is disposed between the main body and a borehole wall in use. The apparatus may be adapted to provide stand off of the main body from the bore in the apparatus is located. More preferably the swellable mantle is further adapted to provide support to a wall of the bore in which it is located.

The apparatus may be used to support a loose or unstable borehole formation, such as a sandstone or shale formation. The apparatus may be adapted for compliant expansion of the swellable mantle to the formation, such that the swellable mantle contacts the formation without unduly stressing the formation. This has the advantage of reducing rock fatigue and reducing the tendency of solids to flow out of the formation with the fluid.

Although the term "swellable mantle" is used herein it should not be taken to imply a single piece of swellable material unless otherwise specified. Certain embodiments of the invention comprise multiple, separate pieces of swellable material which combine to provide the so-called swellable mantle. Other embodiments comprise a unitary swellable mantle.

The swellable material may comprise an ethylene-propylene co-polymer cross-linked with at least one of a peroxide and sulphur. More specifically the swellable member may comprise ethylene propylene diene monomer rubber (EPDM).

Alternatively or in addition the swellable member may contain at least one or multiple water absorbing resins or more precisely any lightly cross-linked hydrophilic polymer embedded within the main swellable member elastomer which may comprise at least one of chloroprene, styrene butadiene or ethylene-propylene rubbers. Such water-absorbing resins are termed "superabsorbent polymers" or "SAPs" and when embedded within the swellable member it may expand when in contact with an aqueous solution.

Examples of water absorbent resin include cross-linked polyacrylic acid salts, cross-linked copolymers of vinyl alcohol and acrylic acid salt, cross-linked products of polyvinyl alcohol grafted with maleic anhydride, crosslinked copolymers of acrylic acid salt and meth-acrylic acid salt, cross-linked saponification products of methyl acrylate-vinyl acetate copolymer, cross-linked products of starch-acrylic acid salt graft copolymer, crosslinked saponification products of starch-acrylonitrile graft copolymer, crosslinked saponification products of starch-ethyl acrylate graft copolymer, crosslinked carboxymethyl cellulose and the like.

Alternatively or in addition, the swellable member may comprise an ethylene-propylene-diene polymer with embedded water absorbent resin such that expansion of the swellable member may result from contacting either an aqueous solution or polar liquid such as oil or a mixture of both.

According to a second aspect of the invention there is provided a well completion or hydrocarbon production method comprising the steps of:

a. Providing a swellable mantle over an opening on a main body of an apparatus;

b. Locating the apparatus at a downhole location;

c. Expanding the swellable mantle by exposing it to a predetermined fluid;

d. Maintaining a fluid flow path in the swellable mantle using an insert in the swellable mantle;

e. Allowing fluid flow between an exterior of the apparatus and the at least one opening through the swellable mantle.

The method may comprise the step of allowing fluid to flow through the insert. The method may comprise the step of receiving fluid from the formation and into a well tubing to which the apparatus is coupled.

The method may include the additional step of screening solids from the fluid received from the formation.

The method may include the additional step of moving a screen outwardly of the main body during expansion of the swellable mantle.

The method may include the step of expanding the swellable mantle without changing the surface area of the screen.

The method may include the step of expanding the swellable mantle such that the screen consists of a plurality of discrete screen sections after expansion.

Other preferred and optional features of the second aspect of the invention are defined with respect to the first aspect of the invention.

According to a third aspect of the invention there is provided downhole apparatus comprising a main body having a bore communicating with a well tubing, and at least one opening for fluid flow between an exterior of the main body and the bore; a screen for filtering solids between the exterior of the apparatus and the bore; and a swellable mantle disposed around the main body and arranged to expand upon contact with at least one predetermined fluid and thereby move the screen outwardly of the main body, wherein the swellable mantle comprises a first region located between the main body and the screen which allows the passage of fluid between the exterior of the apparatus and the main body; and a second region, circumferentially adjacent the first region, which substantially prevents passage of fluid between the exterior of the apparatus and the main body.

Thus the invention in this aspect provides a swellable mantle with a surface which is designed to permit or prevent fluid flow through circumferentially separated areas. This facilitates the use of a screen which is not continuous around the circumference of swellable mantle. The discontinuous nature of the screen permits the screen to be moved outwardly of the main body more readily than if a continuous screen were used.

Preferably, the second region is adapted to be expanded into contact with the borehole wall.

The screen is preferably arranged such that any restraining force imparted by the screen onto the swellable mantle which acts against its expansion can be overcome by the swellable mantle. More preferably, substantially no restraining force is imparted on the swellable mantle by the screen.

The apparatus may be arranged such that the surface area of the screen is maintained in use, between an unexpanded condition and an expanded condition. The screen may have a screen surface area; and the swellable mantle may be disposed around the main body between the main body and the screen. Preferably, the swellable mantle is arranged to expand upon contact with at least one predetermined fluid and thereby move the outwardly of the main body while maintaining the screen surface area.

The screen may be discontinuous around the circumference of the main body. The screen may consist of multiple portions of screening material, which may be discrete in an expanded condition of the apparatus. The multiple portions may additionally be discrete in an unexpanded condition of the apparatus. Preferably, the swellable member is disposed around the main body between the main body and the screen such that on expansion the screen is moved outwardly of the main body. The screen may comprise at least two discrete screen sections circumferentially spaced on the apparatus.

Other preferred and optional features of the third aspect of the invention are defined with respect to the first and second aspects of the invention.

According to a fourth aspect of the invention there is provided a well completion or hydrocarbon production method comprising the steps of:

a. Providing a swellable mantle over an opening on a main body of an apparatus;

b. Locating the apparatus at a downhole location;

c. Expanding the swellable mantle by exposing it to a predetermined fluid to thereby move a screen outwardly of the main body;

d. Allowing fluid to flow between an exterior of the apparatus and the at least one opening through a first region of the swellable mantle located between the main body and the screen, while substantially preventing passage of fluid between the exterior of the apparatus and the main body in a second region of the swellable mantle, circumferentially adjacent the first region.

The method may comprise the step of receiving fluid from the formation and into a well tubing to which the apparatus is coupled.

The method may include the additional step of screening solids from the fluid received from the formation.

The method may include the step of expanding the swellable mantle without changing the surface area of the screen.

The method may include the step of expanding the swellable mantle such that the screen consists of a plurality of discrete screen sections after expansion.

Other preferred and optional features of the fourth aspect of the invention are defined with respect to the first to third aspects of the invention.

According to a fifth aspect of the invention there is provided a downhole apparatus comprising a main body having a bore communicating with a well tubing, and at least one opening for fluid flow between an exterior of the main body and the bore; a screen for filtering solids between the exterior of the apparatus and the bore having a screen surface area; and a swellable member disposed around the main body between the main body and the screen, wherein the swellable member is arranged to expand upon contact with at least one predetermined fluid and thereby move the screen outwardly of the main body while maintaining the screen surface area.

Other preferred and optional features of the fifth aspect of the invention are defined with respect to the first to fourth aspects of the invention.

According to a sixth aspect of the invention there is provided a downhole apparatus comprising a main body having a bore communicating with a well tubing, and at least one opening for fluid flow between an exterior of the main body and the bore; a screen for filtering solids between the exterior of the apparatus and the bore; and a swellable member disposed around the main body between the main body and the screen, wherein the swellable member is arranged to expand upon contact with at least one predetermined fluid and thereby move the screen outwardly of the main body, wherein the screen comprises at least two discrete screen sections circumferentially spaced on the apparatus.

Other preferred and optional features of the sixth aspect of the invention are defined with respect to the first to fifth aspects of the invention.

Use of the first, third, fifth and sixth aspects of the invention in well completion or production methods is within the scope of the invention. A volume of hydrocarbon obtained by using the apparatus or methods described also forms part of the invention.

BRIEF DESCRIPTION OF THE DRAWINGS

There will now be described, by way of example only, various embodiments of the invention with reference to the following drawings, of which.

DETAILED DESCRIPTION

Figures 1, 2:
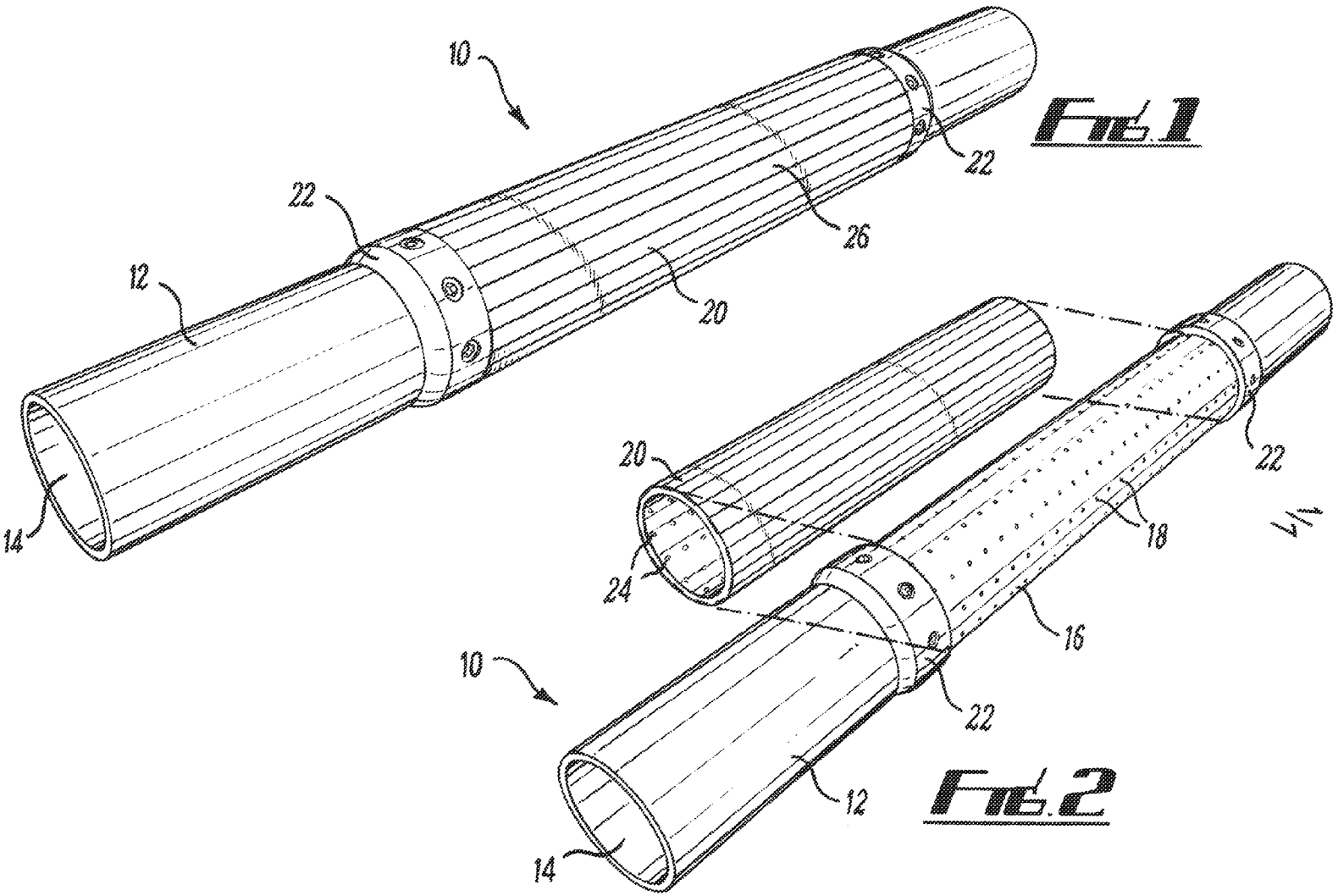
FIG. 1 is a perspective view of an apparatus in accordance with a preferred embodiment of the invention.
FIG. 2 is a perspective view of the apparatus of FIG. 1 with the swellable mantle removed to show other components.
Figure 3:
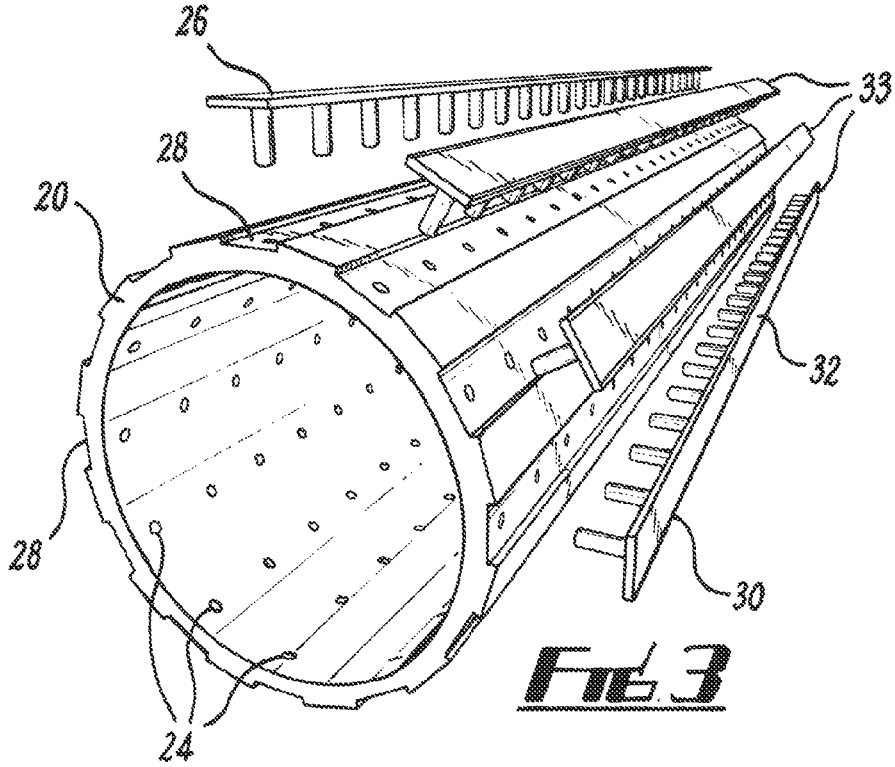
FIG. 3 is an exploded view of the swellable mantle of the apparatus of FIGS. 1 and 2.

Referring firstly to FIGS. 1 to 3, there is shown a downhole apparatus, generally depicted at 10, in accordance with an embodiment of the invention. The apparatus 10 comprises a main body 12 formed from tubular base pipe. The body 12 is adapted to be coupled to well tubing (not shown) such that the bore 14 of the apparatus communicates with the bore of the well tubing.

A section 16 of the main body 12 extending over a length of the apparatus is provided with openings 18 or perforations distributed longitudinally and circumferentially on the section 16. The openings are through-openings from an exterior of the main body 12 to the bore 14. In this embodiment, the openings 18 are regularly distributed, although in alternative embodiments other arrangements of openings may be provided.

Disposed over the main body 12 is a swellable mantle 20. FIG. 2 shows the mantle removed from the apparatus 10. The swellable mantle 20 is a substantially tubular member shaped to fit over the section 16 of the apparatus. The swellable mantle is sized to be bonded or slipped onto the main body, and is located on the section 16 by end rings 22. The end rings 22 are secured to the main body to prevent axial and radial movement and to abut the respective ends of the swellable mantle 20.

The swellable mantle 20 is provided with apertures 24 and inserts 26 to the apertures. The inserts 26 are located in longitudinal recessed grooves 28 on the outer surface of the swellable mantle 20. The inserts 26 will be described in more detail below.

The swellable mantle 20 is formed from a material which is selected to expand on contact with a predetermined fluid. Such swellable materials are known in the art. In this example, the swellable mantle is required to swell in oil, and the material comprises ethylene propylene diene monomer rubber (EPDM). In an alternative embodiment, where the swellable mantle is required to swell in water, the material comprises any lightly crosslinked hydrophilic polymer embedded within the main swellable member elastomer, such as at least one of chloroprene, styrene butadiene or ethylene-propylene rubbers. Such water-absorbing resins are termed "superabsorbent polymers" or "SAPS" and when embedded within the swellable member may expand when in contact with an aqueous solution. In a further alternative embodiment, the swellable member comprises an ethylene-propylene-diene polymer with embedded water absorbent resin such that expansion of the swellable member results from contacting either an aqueous solution or polar liquid such as oil or a mixture of both.

The apertures 24 function to allow fluid to flow from the exterior of the swellable mantle 20 to its interior. When the swellable mantle is positioned on the main body 12, the apertures 24 allow fluid flow from the exterior of the apparatus to the main body 12 and through the openings 18 in the main body to the bore 14. In this embodiment, the spacing of the apertures 24 corresponds to the spacing of the openings 18, such that the apertures 24 and openings 18 may be aligned to provide minimal resistance to fluid flow from the exterior of the apparatus to the bore 14.

The swellable mantle 20 functions to expand on contact with a well bore fluid such that the outer surface of the apparatus comes into contact with the borehole wall. The dimensions and properties of the swellable mantle are selected for compliant expansion of the swellable mantle into contact with the borehole wall, such that an appropriately low force is imparted to the borehole to create a seal, but to prevent damage to the rock formation or sandface. The dimensions and material of the swellable mantle are also selected to expand into a washout zone in the borehole to similarly create a seal with a suitably low force on the formation. In this way, the formation is supported from collapse towards the main body 12, but without damaging the formation in a way that would increase the inflow of solids.

The insert includes a screen support 30 and screen material 32. The insert 26 therefore defines screen sections 33 of the apparatus along circumferentially spaced longitudinal regions of the swellable mantle 20. Disposed between the screen sections are longitudinal regions of the swellable mantle 20 which substantially prevent fluid flow to the interior of the mantle 20. In this regard, it is noted that the swellable material may permit fluid penetration by diffusion through the swellable material, but does not permit fluid flow such as that required for the inflow of production fluids into the bore 14 or the injection of fluids from the bore 14 into the formation.

Figure 4:
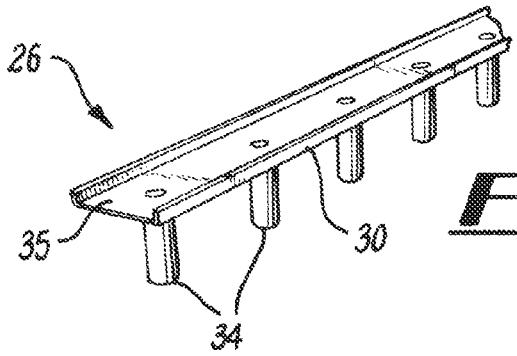
FIG. 4 is a perspective view of an insert used with the apparatus of FIGS. 1, 2 and 3.
Figure 5A:
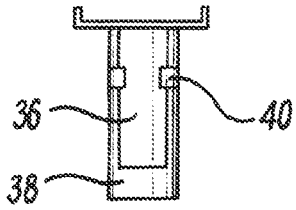
FIGS. 5A and 5B are schematic views of the insert of FIG. 4 in retracted and extended conditions respectively.
Figure 5B:
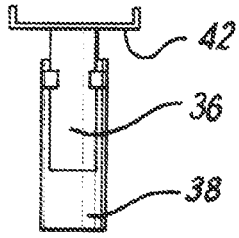

FIGS. 4, 5A and 5B show the insert 26 in more detail, with the screen material 32 removed. The insert 26 includes a plurality of conduits 34 which extend through the swellable mantle to the main body. Multiple conduits are connected by a channel 35 defined by the screen support 30. The conduits 34 each comprise a first member 36 received in a second member 38. The first and second members 36, 38 are movable relative to one another to accommodate expansion of the swellable mantle 20. The conduits function to maintain the flow path of the aperture after expansion. In alternative embodiments of the invention, the conduits, or a subset of conduits, are provided with flow control members such as valves or check valves to restrict fluid flow therethrough.

When assembled, the second member 38 is an interference fit with the aperture 24 of the swellable mantle into which it locates. The undersurface 42 of the screen support 30 is bonded to the surface of the swellable mantle 20 along the longitudinal groove 28. When the swellable mantle expands, the first member 36 moves relative to the second member 38 such that the conduit telescopically extends.

In alternative embodiments, the second member 38 may be fixed to the main body 12 and/or may be received in the opening 18 in the main body.

Figure 6:
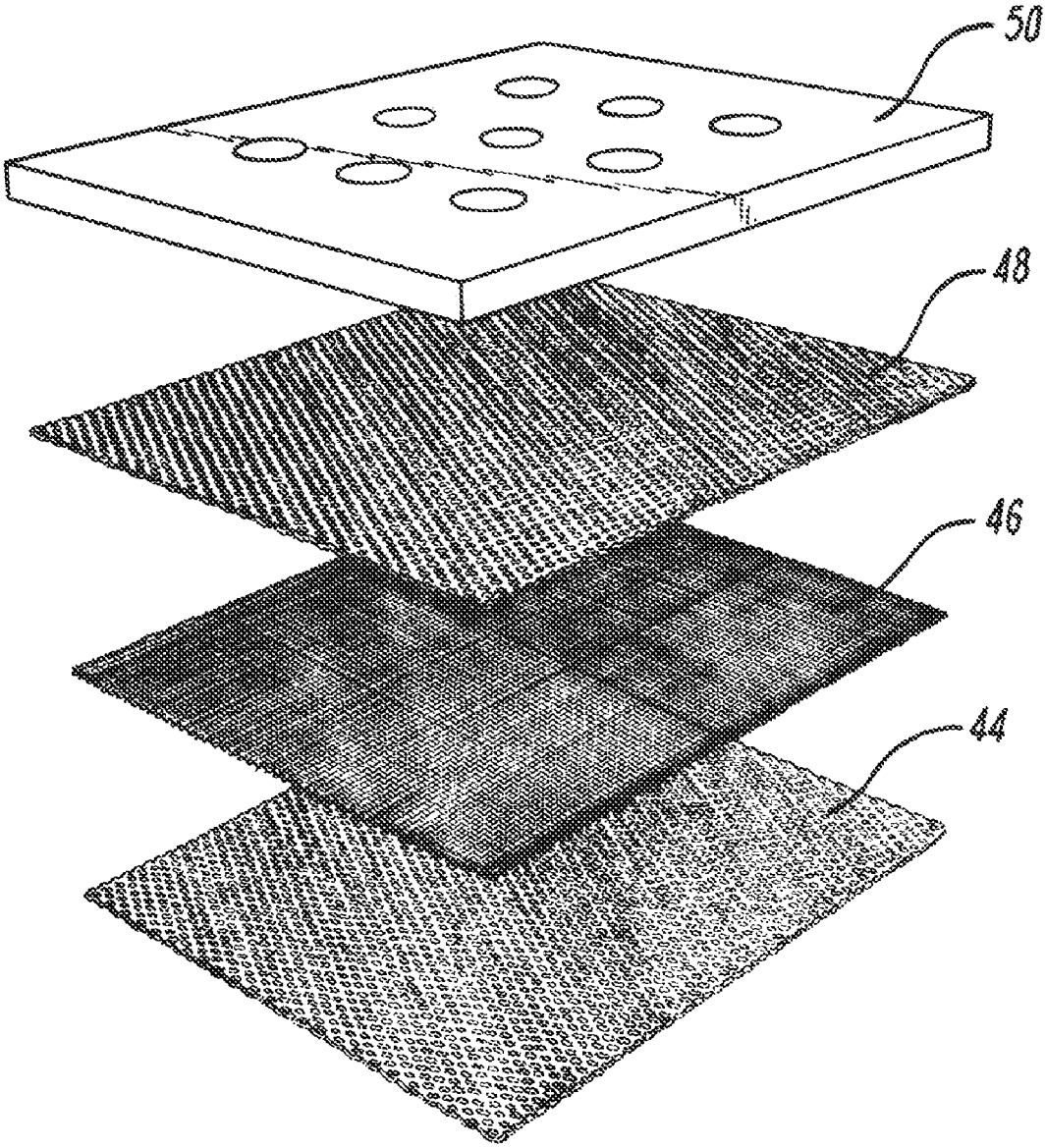
FIG. 6 is a schematic exploded view of a filter used in accordance with embodiments of the invention.

Referring now to FIG. 6, the screen material 32 is shown as comprising a plurality of overlaid layers. Adjacent the screen support 30 is provided a drainage support mesh 44, onto which is overlaid a filter mesh 46. The filter mesh is selected to have an appropriate mesh grade for filtering solids which may be produced from the formation. Typically, the filter mesh will have a mesh grade of around 100 to 300 microns. Over the filter mesh 46 is a further drainage support mesh 48, and finally an outer protective shroud 50, having relatively large apertures, is provided on the exterior of the screen material.

The present invention encapsulates embodiments in which different screen sections are provided with different filter grades. The invention also facilitates customisation of the apparatus by selecting appropriate filter grades during assembly of the apparatus.

Figure 7:
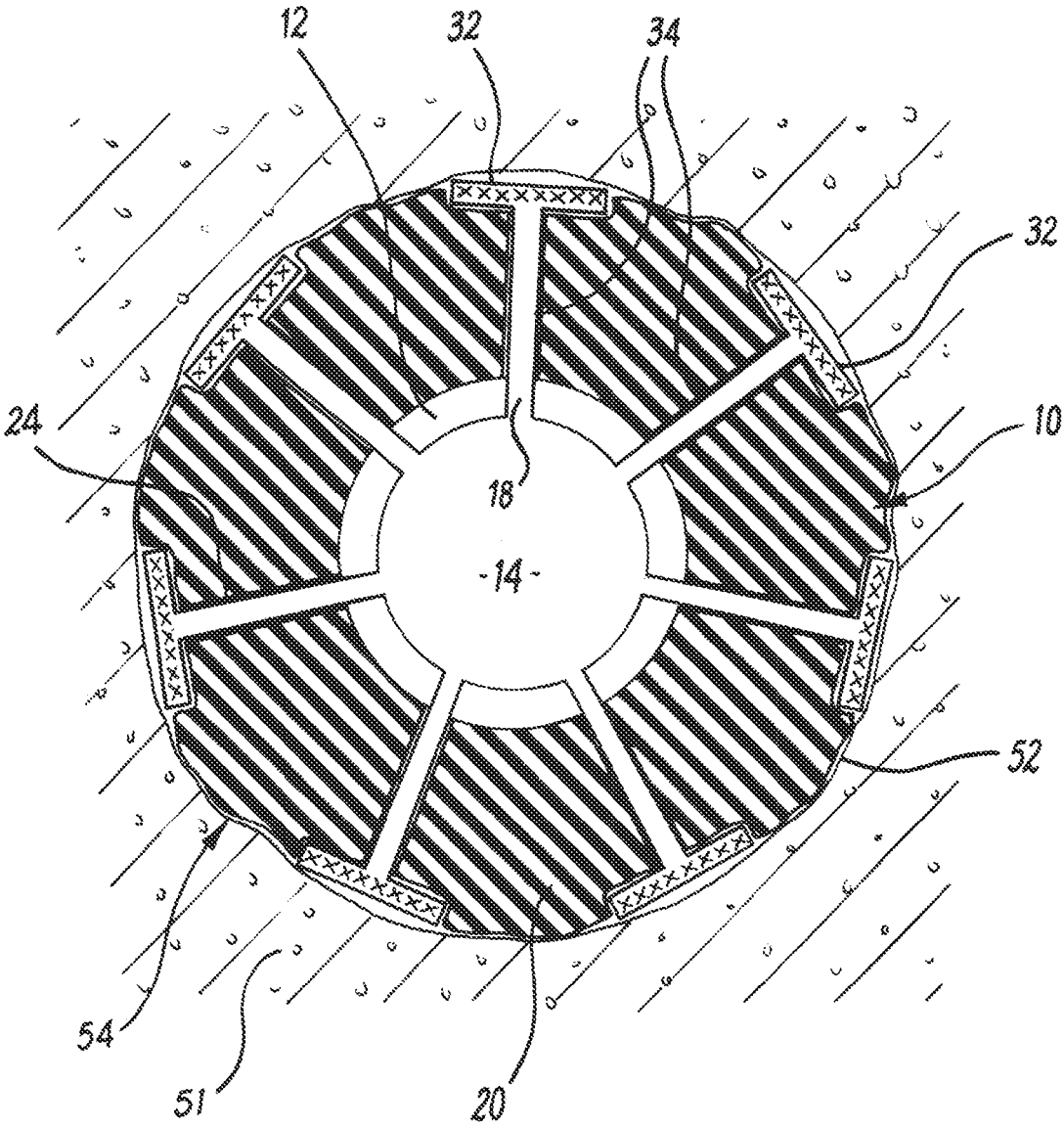
FIG. 7 is a schematic sectional view of the apparatus of FIG. 1 in use in a wellbore.

FIG. 7 shows the apparatus 10 in use in a borehole, in a swelled condition. The apparatus 10 has been run to a location in a sand-producing formation 51, and exposure to wellbore fluids has caused the swellable mantle 20 to expand into contact with the borehole wall 52. As expansion takes place, the conduits 34 defined by the inserts 26 telescopically extend such that a bounded conduit is formed between the exterior of the apparatus and the openings 18 in the main body 12. The inserts prevent the swellable mantle 20 from expanding to close the apertures 24.

The screen sections 33 are placed adjacent to the sandface by expansion of the swellable mantle under the insert, and adjacent regions 54 of the swellable mantle form a compliant seal on the borehole wall 52. Fluid flow from the formation is permitted in the areas at which the screen sections 32 are provided, and is directed through the apertures 24, via the conduits 34, and into the bore 14. Flow is not permitted through the regions 54.

This embodiment of the invention provides compliant expansion of a swellable member to a borehole wall, providing structural support to the borehole without damaging the sandface. The screen sections 33 are carried or moved in a radial direction to be placed adjacent to the sandface. This minimises the annular space in which solids produced from the formation can flow. The flow of fluid is only permitted in the regions at which the screen material is provided, with adjacent sections supported and sealed by the swellable mantle. By providing the plurality of discrete screen sections, movement of the screen outwardly from the main body of the apparatus is accomplished effectively without restraining swelling of the mantle. The embodiment of the invention is also conducive to customisation and configuration of the filter grades used, which may differ between screen sections.

There will now be described alternative embodiments of the invention with reference to FIGS. 8 to 11.

Figure 8:
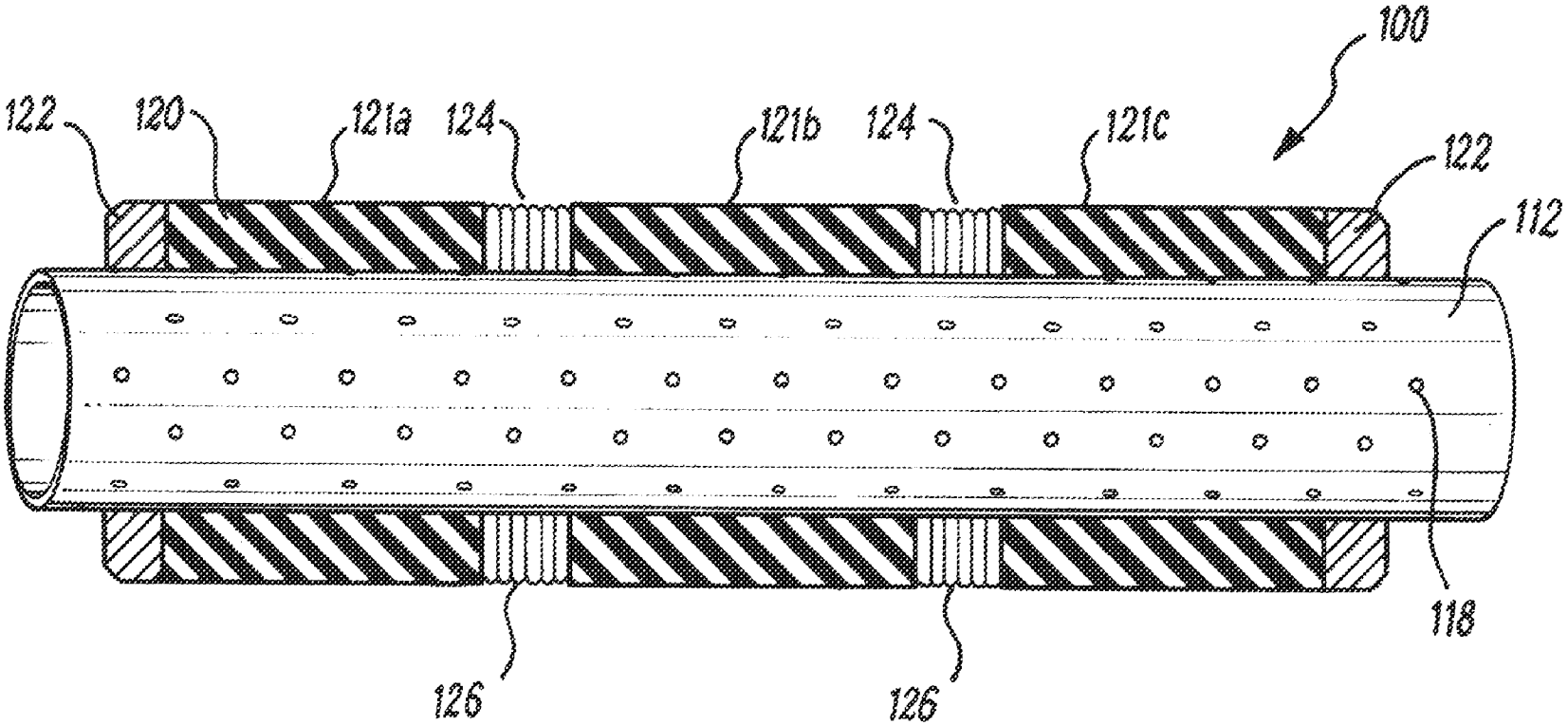
FIG. 8 is a schematic representation of apparatus in accordance with an alternative embodiment of the invention in partial longitudinal section.

Referring to FIG. 8, there is shown a downhole apparatus, generally depicted at 100 consisting of the main body 112 formed from a tubular base pipe and adapted to be coupled to well tubing in the same manner as apparatus 10. In a similar fashion to apparatus 10, the main body 112 is provided with a plurality of through-openings 118 distributed on the body.

Disposed on the body 112, and shown in the Figure in longitudinal section, are end rings 122 and a swellable mantle 120 consisting of three longitudinally spaced sections 121*a*, 121*b*, and 121*c*. Apertures 124 are provided in the form of circumferential grooves to the swellable mantle 120 extending from its outer surface to the main body 112. Provided in the apertures 124 are inserts 126, which in this embodiment are constructed from a permeable rope which is wound around the main body into the aperture. The insert 126 is wound tightly on the main body and provides an abutting surface for the adjacent portions of the swellable mantle 120. In use, the swellable mantle expands outwardly and partially over the insert 126, but without covering the aperture to prevent fluid flow.

The inserts 126 function to permit fluid flow through the aperture and into the main body, while maintaining the flow path and limiting or preventing the expansion of the swellable mantle in the longitudinal direction. The insert additionally functions as a filter for solid particles in the fluid flowing through the aperture.

In an alternative embodiment, the insert 126 is wound from a braided line or wire, or a fibrous material.

Figure 9:
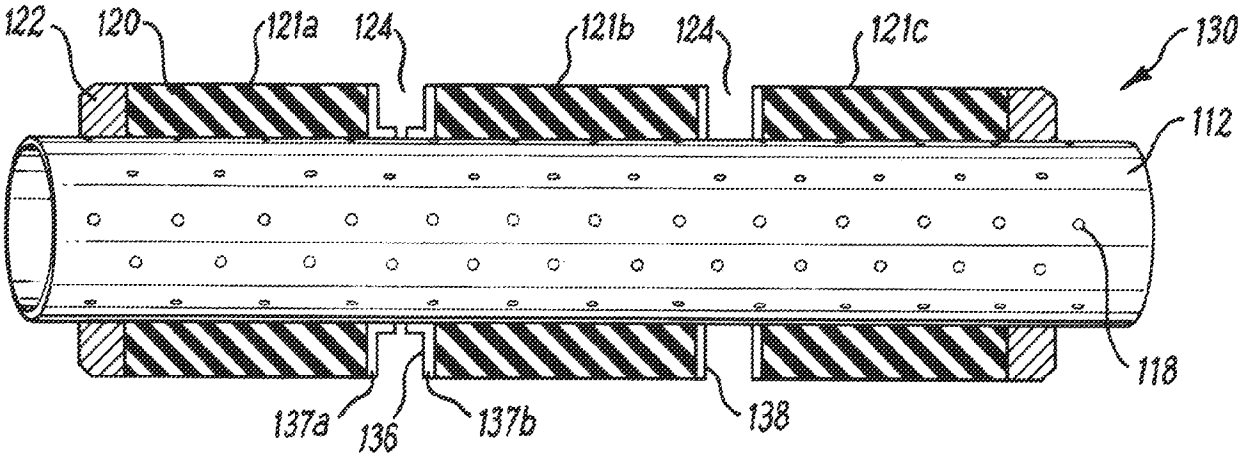
FIG. 9 is a schematic representation of apparatus in accordance with a second embodiment of the invention in partial longitudinal section.

FIG. 9 shows an alternative embodiment, generally depicted at 130, similar to the embodiment of FIG. 8 and with like components identified by like reference numerals. This embodiment differs in the form of the inserts 136, 138 provided to the apertures 124.

Insert 136 is in the form of a cylinder sized to slip onto the main body 112, and provided with first and second flange members 137*a*, 137*b* extending outwardly from the main body. Holes are provided in the insert 136 to allow fluid flow to the main body. The flange members 137*a* and 137*b* function to provide an abutting surface to adjacent portions of the swellable mantle to limit or prevent expansion of the swellable mantle across the aperture 124. Insert 138 consists of a pair of flange portions extending outwardly from the main body, and exposing the main body to the aperture 124.

In this embodiment, one or both of the inserts of 136, 138 may comprise a hardened, erosion-resistant material such as tungsten carbide. This functions to resist erosion caused by solid particles contained in the fluid, which would have a tendency to erode the swellable mantle and/or the openings in the main body 112. It will be appreciated that the apparatus may comprise only one type of the inserts 136, 138.

Figure 10:
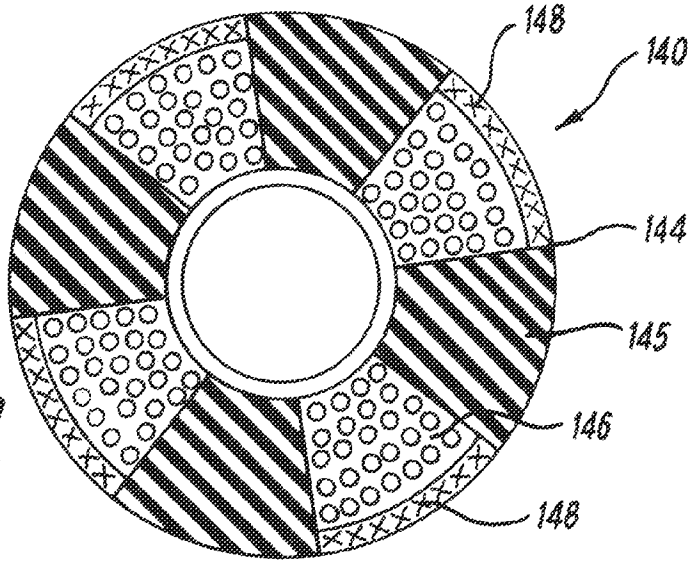
FIG. 10 is a cross-sectional view of apparatus in accordance with a further embodiment of the invention.

FIG. 10 shows a further alternative embodiment of the invention, generally depicted at 140. In this embodiment, the apertures 144 and the swellable mantle 146 are longitudinal grooves, at the inserts 146 are formed from blocks of sintered metal material. The blocks of sintered metal material are overlaid with screen sections 148 before filtering solids from fluid flowing through the apertures 144 and into the main body. In use, the swellable mantle expands outwardly and partially over the screen section, but without covering the aperture to prevent fluid flow. In alternative embodiments, the apertures 144 are helical or circumferential slots or holes in the swellable mantle.

Figure 11B:
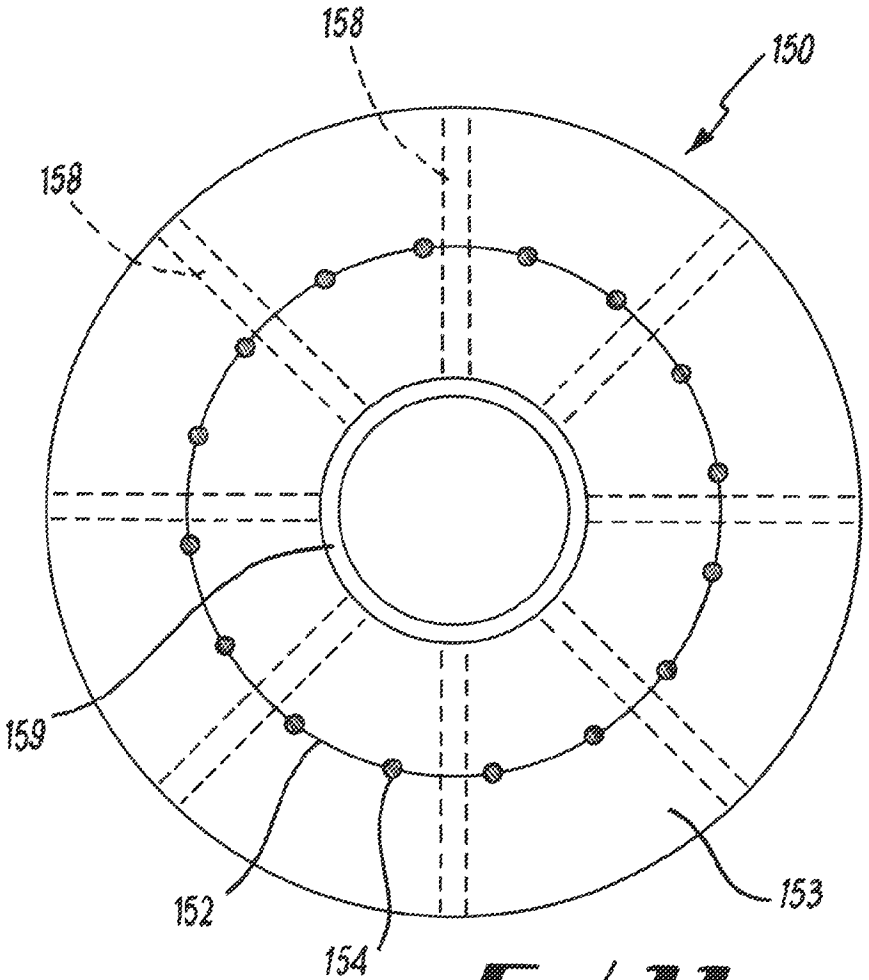
FIG. 11B is a cross-sectional view of the apparatus of FIG. 11A in an expanded configuration.
Figure 11A:
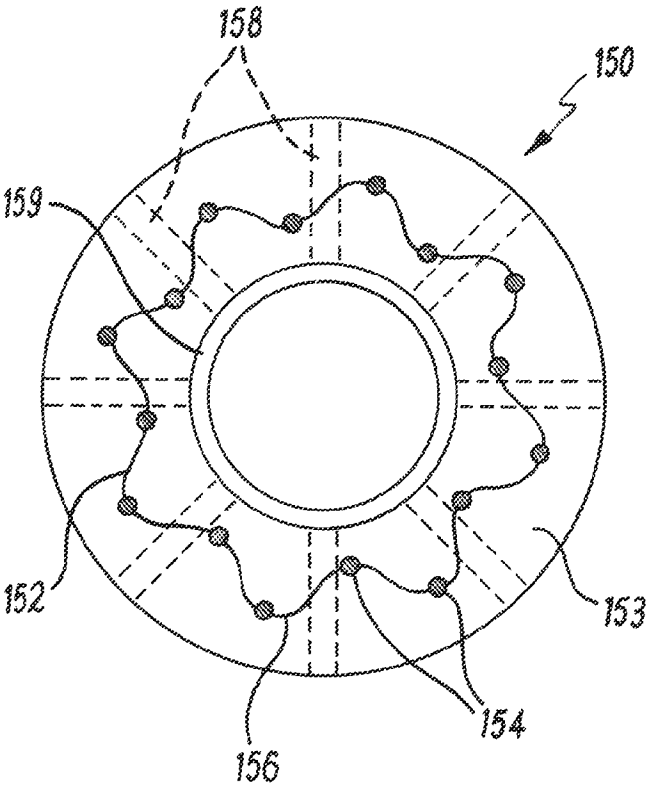
FIG. 11A is a cross-sectional view of apparatus in accordance with a further embodiment of the invention.

A further alternative embodiment is shown in FIGS. 11A and 11B. In this embodiment, shown generally at 150, a substantially tubular screen 152 is embedded into a swellable mantle 153. Apertures 158 are provided in the mantle 153 to allow fluid flow to the main body 159. The screen 152 comprises longitudinal support members 154 which function to provide support to the relatively flexible screen material 156. In FIG. 13A, the screen material is folded, bent or creased to such that is radial dimension is less than the maximum radial dimension which can be defined by the screen 152. The screen has a fixed surface area, but is embedded into the swellable mantle such that it may expand radially on expansion of the swellable material to a position shown in FIG. 13B, without stretching the screen material or affecting the filter grade.

Variations to the above-described embodiments are within the scope of the invention. For example, any of the described insert configurations could be used in combination on the same apparatus in the scope of the invention. Combinations of features other than those expressly claimed are within the scope of the invention.

In further alternative embodiments of the invention, the apertures, or selected apertures in the swellable mantle, are provided with flow control members such as valves or check valves to restrict fluid flow therethrough.

The present invention in its various aspects provides an improved and alternative downhole apparatus and method offering improved performance and/or wider operating parameters than the apparatus of the prior art.

The invention claimed is:

1. A downhole apparatus comprising:

a main body having a bore communicating with a well tubing and at least one opening for fluid flow between an exterior of the main body and the bore;

a screen for filtering solids between the exterior of the apparatus and the bore; and a swellable mantle disposed around the main body and arranged to expand upon contact with at least one predetermined fluid and thereby move the screen outwardly of the main body, wherein the swellable mantle comprises:

a plurality of flow regions located between the main body and the screen which allows the passage of fluid between the exterior of the apparatus and the main body; and a second region, disposed between the plurality of flow regions in a circumferential direction of the swellable mantle, which substantially prevents passage of fluid between the exterior of the apparatus and the main body.

2. The apparatus as claimed in claim 1, wherein the second region is adapted to be expanded into contact with the borehole wall.

3. The apparatus as claimed in claim 1, wherein the screen has a screen surface area, and the swellable mantle is arranged to move the screen outwardly of the main body while maintaining the screen surface area.

4. The apparatus as claimed claim 1, wherein the screen is discontinuous around the circumference of the main body.

5. The apparatus as claimed in claim 1, wherein the screen consists of multiple portions of screen material which are discrete in an expanded condition of the apparatus.

6. The apparatus as claimed in claim 5, wherein the multiple portions are discrete in an unexpanded condition of the apparatus.

7. The apparatus as claimed in claim 1, wherein the screen comprises at least two discrete screen sections circumferentially spaced on the apparatus.

8. The apparatus as claimed in claim 1, wherein the apparatus comprises at least two screens or screen sections having different filter grades.

9. The apparatus as claimed claim 1, wherein an insert is provided in an aperture in the swellable mantle.

10. The apparatus as claimed in claim 9, wherein the insert functions to limit the expansion of the swellable mantle in at least one direction.

11. A well completion method comprising the steps of:

providing an apparatus at a downhole location, the apparatus comprising a swellable mantle over at least one opening on a main body of the apparatus;

expanding the swellable mantle by exposing it to a predetermined fluid to thereby move a screen outwardly of the main body; and allowing fluid to flow between an exterior of the apparatus and the at least one opening through a plurality of flow regions of the swellable mantle located between the main body and the screen, while substantially preventing passage of fluid between the exterior of the apparatus and the main body in a second region of the swellable mantle, disposed between the plurality of flow regions in a circumferential direction of the swellable mantle.

12. The method as claimed in claim 11, comprising the additional step of receiving fluid from the formation and into a well tubing to which the apparatus is coupled.

13. The method as claimed in claim 11, comprising the additional step of screening solids from the fluid received from the formation.

14. The method as claimed in claim 11, comprising the additional step of expanding the swellable mantle without changing the surface area of the screen.

15. The method as claimed in claim 11, comprising the additional step of expanding the swellable mantle such that the screen consists of a plurality of discrete screen sections after expansion.

16. A hydrocarbon production method comprising the steps of:

providing a well completion by the method of claim 11; and allowing fluid to flow through the swellable mantle between an exterior of the apparatus and the at least one opening in the main body.

17. The method as claimed in claim 16, comprising the additional step of receiving fluid from the formation and into a well tubing to which the apparatus is coupled.

18. The method as claimed in claim 17, comprising the additional step of screening solids from the fluid received from the formation.

19. A downhole apparatus comprising:

a main body having a bore arranged to be coupled with a well tubing and a swellable mantle disposed on the main body, which swellable mantle expands upon contact with at least one predetermined fluid, wherein the main body comprises at least one opening for fluid flow between an exterior of the main body and the bore, and the swellable mantle is provided with an insert to permit the passage of fluid, through the swellable mantle, between the exterior of the apparatus and the at least one opening in the main body, wherein the insert functions as a filter for filtering solid particles from the fluid flowing through an aperture in the swellable mantle.

20. The apparatus as claimed in claim 19, wherein the insert comprises an impermeable metal component having fluid apertures formed therein.

21. The apparatus as claimed in claim 19, wherein the insert comprises an abrasion-resistant or erosion-resistant material.

22. The apparatus as claimed in claim 19, wherein the insert comprises a sintered metal component.

23. The apparatus as claimed claim 19, wherein the insert comprises an elongate material wound into the aperture.

24. The apparatus as claimed in claim 23, wherein the insert is selected from one of a permeable rope, a braided line or a fibrous material.

25. The apparatus as claimed in claim 19, wherein the insert defines a radially extending conduit through an aperture in the swellable mantle comprising a first end adjacent the exterior of the apparatus and a second end adjacent the main body, wherein the conduit is variable in length.

26. The apparatus as claimed in claim 25, wherein the conduit is telescopic and comprises a first member at the first end, movably coupled to a second member at the second end, and is adapted to move relative to the second member on expansion of the swellable mantle.

27. The apparatus as claimed in claim 19, further comprising one or more flow-directing members disposed on an outer surface of the apparatus wherein the one or more flow-directing members provides a fluid path from the exterior of the apparatus to one or more apertures in the swellable mantle.

28. The apparatus as claimed in claim 27, wherein the apparatus comprises multiple inserts, and the flow-directing member is coupled to multiple inserts.

29. The apparatus as claimed in claim 19, further comprising a screen for filtering solids between the exterior of the apparatus and the bore.

30. The apparatus as claimed in claim 29, further comprising one or more flow-directing members disposed on an outer surface of the apparatus, wherein the one or more flow-directing members provides a fluid path from the exterior of the apparatus to one or more apertures in the swellable mantle, and wherein the screen is disposed in the flow-directing member.

31. The apparatus as claimed in claim 29, wherein the screen comprises at least two discrete screen sections circumferentially spaced on the apparatus.

32. The apparatus as claimed in claim 29, further comprising at least two screens or screen sections having different filter grades.

33. A well completion method comprising the steps of:

providing an apparatus at a downhole location, the apparatus comprising a main body and a swellable mantle over an opening on the main body;

expanding the swellable mantle by exposing it to a predetermined fluid; and maintaining a fluid flow path in the swellable mantle using an insert in the swellable mantle, wherein the insert functions as a filter for filtering solid particles from the fluid flowing through an aperture in the swellable mantle.

34. The method as claimed in claim 33, comprising the additional step of moving a screen outwardly of the main body during expansion of the swellable mantle.

35. The method as claimed in claim 34, comprising expanding the swellable mantle without changing the surface area of the screen.

36. The method as claimed in claim 34, comprising expanding the swellable mantle such that the screen consists of a plurality of discrete screen sections after expansion.

37. A hydrocarbon production method comprising the steps of:

providing a well completion by the method of claim 33, and;

allowing fluid to flow through the swellable mantle between an exterior of the apparatus and the at least one opening in the main body.

38. The method as claimed in claim 37 comprising the additional step of receiving fluid from the formation into a production tubing to which the apparatus is coupled.

39. A downhole apparatus comprising:

a main body having a bore communicating with a well tubing and at least one opening for fluid flow between an exterior of the main body and the bore;

a screen for filtering solids between the exterior of the apparatus and the bore; and a swellable mantle disposed around the main body and arranged to expand upon contact with at least one predetermined fluid and thereby move the screen outwardly of the main body, wherein the swellable mantle comprises:

a first region located between the main body and the screen which allows the passage of fluid between the exterior of the apparatus and the main body; and a second region, circumferentially adjacent the first region, which substantially prevents passage of fluid between the exterior of the apparatus and the main body; and wherein the second region is adapted to be expanded into contact with the borehole wall.

40. A well completion method comprising the steps of:

providing an apparatus at a downhole location, the apparatus comprising a swellable mantle over an opening on a main body of the apparatus;

expanding the swellable mantle by exposing it to a predetermined fluid to thereby move a screen outwardly of the main body; and allowing fluid to flow between an exterior of the apparatus and the at least one opening through a first region of the swellable mantle located between the main body and the screen, while substantially preventing passage of fluid between the exterior of the apparatus and the main body in a second region of the swellable mantle, circumferentially adjacent the first region;

wherein expanding the swellable mantle comprises expanding the second region into contact with the borehole wall.

41. A hydrocarbon production method comprising the steps of:

providing a well completion by the method of claim 40, and;

allowing fluid to flow through the swellable mantle between an exterior of the apparatus and the at least one opening in the main body.

42. A downhole apparatus comprising:

a main body having a bore arranged to be coupled with a well tubing and a swellable mantle disposed on the main body, which swellable mantle expands upon contact with at least one predetermined fluid, wherein the main body comprises at least one opening for fluid flow between an exterior of the main body and the bore, and the swellable mantle is provided with an insert to permit the passage of fluid, through the swellable mantle, between the exterior of the apparatus and the at least one opening in the main body; and wherein the insert defines a radially extending conduit through an aperture in the swellable mantle comprising a first end adjacent the exterior of the apparatus and a second end adjacent the main body, wherein the conduit is variable in length.

43. The apparatus as claimed in claim 42, wherein the conduit is telescopic and comprises a first member at the first end, movably coupled to a second member at the second end, and is adapted to move relative to the second member on expansion of the swellable mantle.

44. A well completion method comprising the steps of:

providing an apparatus at a downhole location, the apparatus comprising a main body and a swellable mantle over an opening on the main body;

expanding the swellable mantle by exposing it to a predetermined fluid;

maintaining a fluid flow path in the swellable mantle using an insert in the swellable mantle;

wherein expanding the swellable mantle comprises varying the length of the radially extending conduit.

45. A hydrocarbon production method comprising the steps of:

providing a well completion by the method of claim 44, and;

allowing fluid to flow through the swellable mantle between an exterior of the apparatus and the at least one opening in the main body.

46. A downhole apparatus comprising:

a main body having a bore arranged to be coupled with a well tubing and a swellable mantle disposed on the main body, which swellable mantle expands upon contact with at least one predetermined fluid, wherein the main body comprises at least one opening for fluid flow between an exterior of the main body and the bore, and the swellable mantle is provided with an insert to permit the passage of fluid, through the swellable mantle, between the exterior of the apparatus and the at least one opening in the main body; and further comprising one or more flow-directing members disposed on an outer surface of the apparatus wherein the one or more flow-directing members provides a fluid path from the exterior of the apparatus to one or more apertures in the swellable mantle.

47. The apparatus as claimed in claim 46, wherein the apparatus comprises multiple inserts, and the flow-directing member is coupled to multiple inserts.

48. The apparatus as claimed in claim 46, further comprising a screen for filtering solids between the exterior of the apparatus and the bore.

49. The apparatus as claimed in claim 46, further comprising one or more flow-directing members disposed on an outer surface of the apparatus, wherein the one or more flow-directing members provides a fluid path from the exterior of the apparatus to one or more apertures in the swellable mantle, and wherein the screen is disposed in the flow-directing member.

50. A well completion method comprising the steps of:

providing an apparatus at a downhole location, the apparatus comprising a main body and a swellable mantle over an opening on the main body;

expanding the swellable mantle by exposing it to a predetermined fluid; and maintaining a fluid flow path in the swellable mantle using an insert in the swellable mantle;

moving a screen outwardly of the main body during expansion of the swellable mantle.

51. The method as claimed in claim 50, comprising the additional step of expanding the swellable mantle without changing the surface area of the screen.

52. The method as claimed in claim 50 comprising the additional step of expanding the swellable mantle such that the screen consists of a plurality of discrete screen sections after expansion.

53. A hydrocarbon production method comprising the steps of:

providing a well completion by the method of claim 50, and;

allowing fluid to flow through the swellable mantle between an exterior of the apparatus and the at least one opening in the main body.

* * * * *